United States Patent [19]

Crofts

[11] Patent Number: 4,776,390

[45] Date of Patent: Oct. 11, 1988

[54] VENTING FILLER CAP

[75] Inventor: John G. Crofts, Columbus, Ind.

[73] Assignee: Cummins Engine Company, Inc., Columbus, Ind.

[21] Appl. No.: 779,526

[22] Filed: Sep. 24, 1985

[51] Int. Cl.[4] ..... F01P 11/02

[52] U.S. Cl. ..... 165/104.32; 123/41.51; 123/41.54

[58] Field of Search ..... 165/104.32; 123/41.51, 123/41.54

[56] References Cited

U.S. PATENT DOCUMENTS

| | | | |
|---|---|---|---|
| 3,425,400 | 2/1969 | Scherenberg | 123/41.51 |
| 3,576,181 | 4/1971 | Neal et al. | 123/41.51 |
| 4,064,848 | 12/1977 | Pabst et al. | 123/41.51 |
| 4,231,424 | 11/1980 | Moranne | 165/104.32 |

FOREIGN PATENT DOCUMENTS

| | | | |
|---|---|---|---|
| 2312645 | 12/1976 | France | 165/104.32 |
| 2007831 | 5/1979 | United Kingdom | 165/104.32 |

*Primary Examiner*—Albert W. Davis, Jr.

*Attorney, Agent, or Firm*—Neuman, Williams, Anderson & Olson

[57] ABSTRACT

The invention consists of an improved apparatus for filling, venting, de-aerating, and detecting the coolant level in an engine coolant system. The apparatus provided has a de-aerating tank with a filler neck disposed on top of the tank. A fill line and a vent line interconnect the engine block coolant jacket and the deaerating tank. At least one radiator vent conduit interconnects the filler neck and the top header tank of the radiator, thereby providing a passageway for gas and coolant. A removable cap is provided having a subtending cup portion disposed within the filler neck. The cup portion defines at least one groove on its outer surface and an orifice disposed within the groove, and having sealing O-rings bands opposite both sides of the groove and a stem connecting to an overflow conduit. When the cap is secured to the filler neck, the flow of coolant and gas from the radiator vent conduit to the filler neck is limited by the size of the orifice. When the cap is removed to fill the system, the flow of coolant and gas in the radiator vent conduit is limited only by the diameter of the radiator vent conduit. An insulated conductor is provided with a bare end portion disposed within the filler neck for detecting the coolant level. The insulated conductor is connected to a light-emitting diode which in turn is connected to the ignition system.

19 Claims, 1 Drawing Sheet

FIG. 1
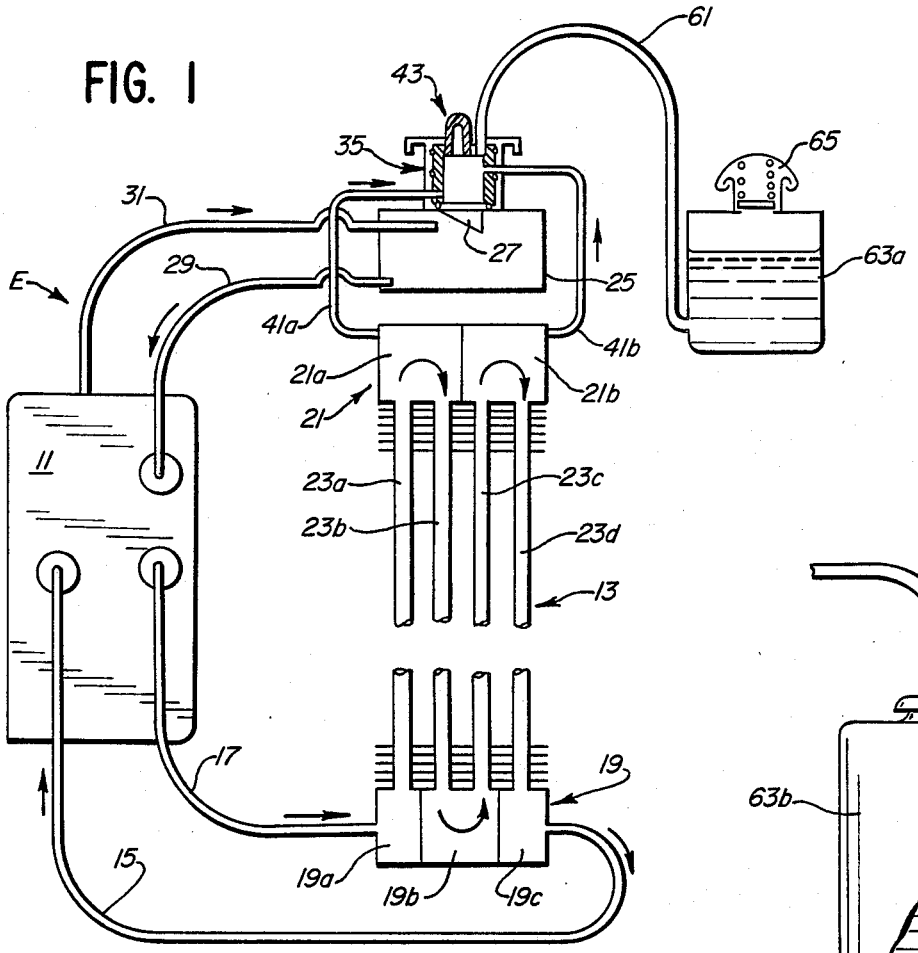
FIG. 3
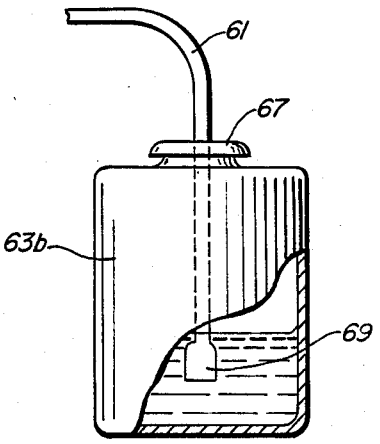
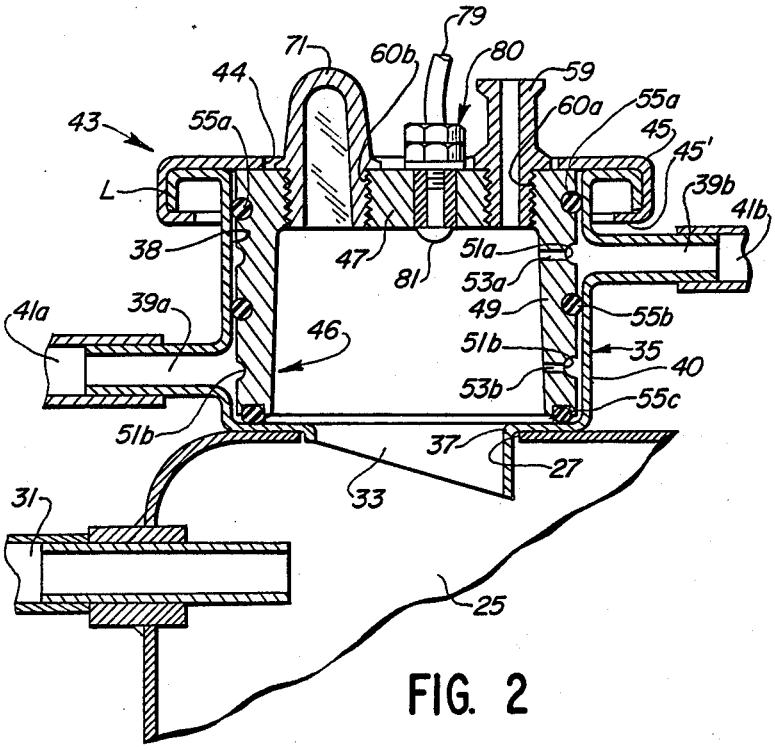
FIG. 2
FIG. 4
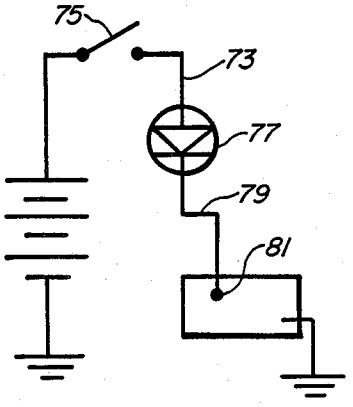

VENTING FILLER CAP

BACKGROUND OF THE INVENTION

This invention relates generally to a simplified apparatus and method for filling, venting and de-aerating a complex engine coolant system.

In an engine equipped with an aftercooler, it is desirable to operate the aftercooler with air at approximately 100° F. In typical high flow coolant systems, one hundred percent of the stream of coolant flows through the single pass radiator when the thermostat is open. The coolant enters the radiator at approximately 195° F.–200° F. and exits the radiator at approximately 185° F.–190° F. Thus, the exiting engine coolant cannot significantly lower the temperature of the aftercooler air. To permit the aftercooler to operate closer to the desirable temperature, some manufacturers have constructed systems where a second radiator in front of the coolant radiator is provided for cooling the aftercooler air. A drawback of such systems is that in cold temperatures the aftercooler is initially fed with air at extremely low temperatures from the air radiator. Aftercooler air at such low temperatures causes inefficient operation of the aftercooler and loud knocking noises. Consequently, these manufacturers must equip their systems with a bypass for the air radiator and a pre-heater for cold weather.

Rather than equipping the engine with a preheater and a second radiator with a bypass, other manufacturers have solved the problem of lowering the aftercooler air temperature by using a low flow, multipass radiator. In a low flow radiator system, only a small percentage, such as twenty percent, of the stream of coolant enters the radiator. The remaining coolant bypasses the radiator. Because a smaller amount of coolant flows through the radiator, the coolant exits the radiator at significantly lower temperatures, such as 135° F. This coolant exits the radiator and cools the aftercooler air at this lower temperature. After cooling the aftercooler air, the coolant from the radiator mixes with the coolant which has bypassed the radiator. The mixed solution then enters the engine block coolant jacket at approximately 185° F. In cold weather when the thermostat is closed, the aftercooler air is warmed with coolant directly from the engine block coolant jacket.

In all radiators, it is necessary to provide a means for de-aerating the system. This need is especially true with multi-pass radiators. Without such a de-aerating means, gas may accumulate in the top header tank of the radiator. This trapped gas could cause a vapor lock in the top header tank which would consequently shut down the cooling process. Thus, to de-aerate the coolant system, a de-aerating tank is typically supplied in communication with the top headers of a multi-pass radiator. Radiator vent lines are supplied to permit the flow of trapped gas from the header tanks to the de-aerating tank.

A drawback of providing a passageway for trapped gas to exit the top header tank is that coolant may also flow from the radiator to the de-aerating tank. One must limit the amount of coolant which flows from the radiator to the de-aerating tank to prevent both inefficient cooling when the thermostat is open and excessive heat loss in cold weather when the thermostat is closed. Inefficient cooling can occur when the thermostat is open because coolant may exit from the top header tank to the de-aerating tank in the radiator vent lines and thus bypass subsequent tubes of the radiator. Therefore, the subsequent passes become less efficient in cooling the coolant. Such bypassing might cause overheating in hot temperatures. Excessive heat loss can occur in cold weather because of "backflow". When the thermostat is in the closed position, the return line to the radiator is closed and coolant from the engine block coolant jacket is initially discharged into the supply line to prevent the normal flow of coolant through the radiator. Backflow occurs when coolant flows out of the engine block coolant jacket, into the exit of the radiator through the supply line, out of radiator through the de-aerating vent lines in the top header tank to the de-aerating tank, and back to the engine block coolant jacket through the fill line interconnecting the de-aerating tank and the engine block coolant jacket. This undesired reverse coolant flow in cold weather causes excessive heat loss and may prevent the defrosting of the windows and the heating of the operator compartment of the vehicle. Preventing backflow is critical in the operation of trucks where operators may idle their vehicles for long periods of time in cold weather either in traffic or when parked on a roadside.

To limit the flow of coolant, manufacturers have used ball check valves in the radiator vent lines at the opening to the de-aerating tanks. The drawbacks of such systems are expense and unreliability. The ball check valve could easily clog from sediments which are common to a engine coolant system. Thus, the manufacturers must provide costly access holes in the de-aerating tanks to permit the cleaning of the ball check valves. Other manufacturers have avoided the expense of providing an access hole by placing manual cock valves in the middle of the radiator vent lines. A drawback of this apparatus is that the valve can be serviced only by removing the radiator vent line. Another drawback of this apparatus is that the radiator vent line must be external to the radiator and de-aerating tank which adds expense to the system. It would be desirable to have a de-aerating apparatus which is more economical, which may be internal to the system and which is easily serviceable.

Another problem with engine coolant systems, especially systems with multi-pass radiators, is the venting of the system to facilitate complete and rapid filling of the system with coolant. Because the radiator vent lines are maintained with narrow openings, the radiator vent lines do not provide sufficient venting of gas to completely and rapidly fill the coolant system.

Some manufacturers have provided a second opening to the atmosphere in the radiator to vent the system when filling it with coolant. To fill the system, a user must open a plug in the top header tank of the radiator before pouring coolant into the system through the filler neck. Because gas may vent through the unplugged vent opening, the system fills rapidly with coolant. However, drawbacks of this system are added expense in providing a second opening in the radiator system and the added procedure which an operator must follow to effectuate rapid and complete filling of the coolant system. Other manufacturers provide manual cock valves in the radiator vent lines to vent the system when filling the system. The cock valves have a fully open position which allows complete venting when filling and a partially open position which allows de-aerating during the operation of the engine coolant system. Besides having the drawback of requiring an external radiator vent line, these systems have the drawback of requiring the operator to perform additional steps to effectuate complete filling of the engine coolant system. Moreover, if the operator forgets to partially close the cock valve, excessive coolant could escape from the radiator during the operation of the engine causing inefficient cooling or excessive heat loss. If the operator inadvertently closes the valve, vapor lock could occur and shut down the cooling system.

SUMMARY OF THE INVENTION

Thus, it is the object of the invention to provide an improved engine coolant system which avoids the aforementioned shortcomings.

It is a more specific object of the invention to provide de-aerating means for low flow, multi-pass radiators which is inexpensive and easily serviceable.

It is a further object to provide an engine coolant system which may be completely and rapidly filled and does not require a second opening in the radiator to the atmosphere or any procedure by the operator other than removal of the radiator cap and insertion of coolant.

It is a still further object of the invention to provide a simple cost efficient means for detecting the coolant level in the radiator of the engine coolant system.

Further and additional objects will appear from the description, accompanying drawings and appended claims.

In accordance with one embodiment of the invention, a de-aerating apparatus is provided for use in an engine coolant system which includes at least an engine block coolant jacket and a multi-pass radiator having a top header tank. The de-aerating apparatus includes a de-aerating tank which is normally contiguous to the top header tank of the radiator. The de-aerating tank defines an opening at its top and has a tapered collar portion subtending the opening of the de-aerating tank. A fill conduit is provided which interconnects the de-aerating tank and the engine block coolant jacket for discharging coolant from the de-aerating tank to the jacket. A vent conduit is also provided which interconnects the de-aerating tank and the engine block coolant jacket for discharging coolant and gas from the jacket to the de-aerating tank. A filler neck is provided which is disposed at the top of the de-aerating tank. The filler neck communicates with the de-aerating tank at the opening of the de-aerating tank, thereby providing for the flow of coolant and gas between the tank and filler neck. The filler neck defines an opening which is disposed at the top of the neck for filling the system with coolant. At least one radiator vent conduit is provided to interconnect the filler neck and the top header tank of the radiator, thereby providing a passageway for gas and coolant from the radiator to the filler neck.

A removable cap is provided normally placed within the filler neck and covering the opening of the filler neck. The cap includes a top portion which defines a first aperture. The cap also includes a plate contiguous with the top portion for securing the cap to the filler neck. The plate defines an opening. The cap further includes a collar portion which is subtending and connected to the top portion. The collar portion has an outer surface which defines at least one groove circumscribing the collar portion. The collar portion also defines an orifice disposed within the groove. Sealing means are provided between the filler neck and the collar portion adjacent to both edges of the groove whereby when the cap is secured to the filler neck, coolant and gas flowing from the radiator vent conduit are restricted to flowing either in the space between the sealing means or into the cap through the orifice. In this manner, the radiator vent conduit serves both the function of venting when the cap is removed and the system is being filled and the function of de-aerating when the cap is secured on the filler neck and the engine is operating.

The cap also has a hollow stem portion attached to the top portion of the cap and protruding outward from the filler neck. The hollow stem portion communicates with the first aperture of the top portion and interconnects the top portion of the cap and an overflow conduit. The overflow conduit interconnects an overflow bottle and the hollow stem of the cap, thereby providing a passageway for the flow of gas and coolant between the overflow bottle and the filler neck. The overflow bottle has a pressure cap for maintaining the pressure in the coolant system. The apparatus further includes an electrical device for detecting coolant level. An insulated conductor is provided which extends through a second aperture in the top portion of the cap. The insulated conductor has a bare end portion disposed with the filler neck. The insulated conductor is attached to a light emitting diode which in turn is connected to the ignition system. When the ignition switch is on and the bare end portion of the conductor is immersed in coolant, the diode will emit light, thus indicating a filled coolant system.

DESCRIPTION

For a more complete understanding of the invention reference should be now be made to the drawings wherein:

FIG. 1 is a schematic view of an automotive coolant system with a multi-pass radiator and employing therein one embodiment of the present invention.

FIG. 2 is an enlarged fragmentary, vertical sectional view of the improved radiator cap and filler neck and the de-aeration tank shown in FIG. 1.

FIG. 3 is an enlarged, fragmentary side elevational view of an alternative overflow bottle partially cut away.

FIG. 4 is a schematic diagram of the coolant detector circuit.

Referring to FIG. 1 of the drawings, a coolant system E for an internal combustion engine 11 is shown through which a coolant is circulated by a pump, not shown. The coolant flows from a radiator 13 through a conduit 15 to a cooling jacket formed within the engine block. The coolant returns to the radiator from the cooling jacket through a return conduit 17 to the radiator 13. A thermostat, not shown, controls the flow of coolant through supply line 15 and return line 17. When the engine block does not require cooling, the thermostat causes the return line 17 to close and a discharge of coolant into the supply line 15 from the engine block coolant jacket which prevents the normal flow of coolant between the jacket and radiator 13.

The radiator 13 includes a bottom header tank 19 having a first compartment **19*a*, a second compartment 19*b* which is contiguous thereto, and a third compartment 19*c* which is contiguous to the second compartment 19*b*. The compartments are disposed in side by side relation. Radiator 13 also includes a top header 21 housing a first compartment 21*a* and a second compatment 21*b* contiguous thereto. A first tube 23*a* interconnects compartments 19a and 21a; a second tube 23b interconnects compartments 19b and 21a; a third tube 23c interconnects compartments 19b and 21b and a fourth tube 23d interconnects compartments 19c and 21b. During operation of the engine while the thermostat is open, the coolant normally circulates through the system in the following manner: (a) through the engine cooling jacket, (b) then through return line 17, (c) into compartment 19a of the radiator bottom header tank, (d) up first tube 23a, into the compartment 21a of the radiator to header tank, (e) down second tube 23b into the second compartment 19b, (f) up third tube 23c, into second compartment 21b, (g) down fourth tube 23d, into third compartment 19c, (h) out through supply line 15** and back to the engine block cooling jacket.

In a low flow mode, only a portion of the coolant flow from the engine block cooling jacket enters the radiator. The remainder of the coolant bypasses the radiator and mixes with the coolant exiting the radiator after it has cooled the aftercooler air.

During normal operation of the engine coolant system, gas accumulates in the system. If sufficient gas is trapped in top header 21 of the radiator, vapor lock can occur in the compartments 21a, 21b. Such vapor lock could prevent or substantially hinder the coolant flow through the system. To avert this possibility, a first container or de-aerating tank 25 is provided which is preferably normally contiguous to radiator 13. As seen in FIG. 2, the de-aerating tank includes an opening 27 formed in the top surface thereof. A fill conduit 29, see FIG. 1, interconnects tank 25 and the engine block cooling jacket thereby providing for coolant flow from tank 25 to the jacket. One end of the fill conduit 29 is adjacent the bottom of tank 25 thereby effecting efficient circulation of the coolant. A gas vent conduit 31 interconnects tank 25 and the cooling jacket and provides a passageway for discharging gas and excess coolant from the jacket. One end of conduit 31 is adjacent the top of tank 25. De-aerating tank 25 also includes a tubular collar 33 protruding inwardly from top opening 27. As shown in FIG. 2, the bottom of collar 33 is cut on the diagonal and generally faces towards conduit 31 thereby facilitating the flow of gas from the vent conduit 31 to the opening 27 of the de-aerating tank 25.

A filler neck 35 is fixedly mounted on the top surface of the de-aerating tank 25 and is provided with a first, or bottom, opening 37 and a second, or upper, opening 38, which is normally covered as will be described more fully hereinafter. An upstanding cylindrical wall 40 of neck 35 is provided with a lower vent connection 39a and an upper vent connection 39b. Referring to FIG. 1, vent conduit 41a interconnects the top header first compartment 21a of the radiator 13 and vent connection 39a. A second vent conduit 41b interconnects the top header second compartment 21b of the radiator and vent connection 39b. The vent connections coact to effect de-aeration of the top header of the radiator during the operation of the coolant system. The vent connections 39a and 39b are of sufficiently large diameter so that the radiator 13 is easily vented to permit complete and rapid filling of the engine coolant system.

Referring to FIG. 2, a removable cap 43 of composite construction is provided which is adapted to cover the opening 38 of filler neck 35, thereby sealing the latter from the atmosphere. Cap 43 includes an annular member 45 which is provided with a peripheral locking flange 45' which, when the cap is manually turned, is adapted to slidably interlock with a peripheral lip L encircling opening 38. The cap 43 also includes a separate inverted cuplike member 46 which is manually inserted into the neck 35 through opening 38 prior to member 45 being assembled on the neck. The closed end 47 of member 46 is adapted to be contiguous to and subtend the central portion of member 45 when the latter is assembled on the neck. The depending wall 49 of member 46 is cylindrical and is in sliding, sealing engagement with neck wall 40. The exterior of depending wall 49 is provided with a first annular groove 51a proximate the upper vent connection 39b and a second annular groove 51b proximate the lower vent connection 39a. Both grooves circumscribe the wall 49. A radially extending first orifice 53a is formed in wall 49 and terminates at one end in annular groove 51a. A similar radially extending second orifice 53b is provided for the second annular groove 51b. An O-ring seal 55a encompasses the exterior of wall 49 and is positioned between the annular groove 51a and the central portion of member 45. A second O-ring seal 55b is disposed between the depending wall 49 and the upstanding wall 40 of the filler neck 35 to provide a seal between the annular groove 51a and the second annular groove 51b. A third O-ring seal 55c is located within an annular groove formed at the bottom of wall 49 and provides a seal between the second annular groove 51b and the opening 37.

As seen in FIG. 2, gas and coolant flowing from the first radiator vent conduit 41a flows in the space between the walls 40 and 49 within an area defined by O-rings 55b and 55c and through orifice 53b. Gas and coolant flowing from the second radiator vent conduit 41b flows in the space between the walls 40 and 49 defined by the O-rings 55a and 55b and through orifice 53a. From the foregoing it will be seen that the vent conduits 41a and 41b in combination with cap 43 and filler neck 35 serve both the function of providing a means for venting the system when filling and of de-aerating the radiator 13 during the normal operation of the engine while still limiting the flow of coolant from the radiator 13 to the de-aerating tank 25.

During the normal operation of the engine and with cap 43 secured to filler neck 35, the flow of coolant from the radiator 13 to the de-aerating tank 25 is limited by the size of each orifice 53a, 53b. Thus, orifices of small diameter, such as one-sixteenth of an inch, will substantially limit "backflow" when the thermostat is closed and also effectively prevent the flow of substantial amounts of coolant from the top header tank to the de-aerating tank 25 when the thermostat is open. Thus, both excessive heat loss and inefficient cooling are prevented. However, complete venting is also permitted because, when the members 45, 46 of cap 43 are removed for filling the system with coolant, vent connections 39a and 39b are not obstructed.

A hollow stem 59 is mounted in a port 60a formed in the closed end 47 of member 46 and extends upwardly through an enlarged opening 44 formed in the central portion of annular member 45. Referring to FIG. 1, an overflow conduit 61 interconnects stem 59 and an overflow container 63a whereby gas and excess coolant may flow into the container 63a when the engine heats and expands the coolant. The coolant collected in container 63a flows back into the system when the engine cools thereby causing the coolant to contract. A pressure cap 65 is provided on container 63a which maintains the system at a pressure above atmospheric pressure to inhibit the boiling of the coolant in the system. The pressure cap 65 automatically prevents dangerous pressures from occurring within the system.

In the alternative as shown in FIG. 3, an overflow container **63*b* may be provided with a conventional atmospheric vent cap 67. To maintain pressure in the system, a pressure/vacuum valve 69 is provided at the end of the overflow conduit 61 which is disposed within the container interior. However, the present invention does not require the use of an overflow container because if desired, the excess coolant could be discharged directly onto the ground from the overflow conduit 61**. In this latter arrangement a pressure greater than atmospheric pressure is maintained by a pressure/vacuum valve located at either end of the overflow conduit.

Means for detecting the level of coolant in the system is provided by a sight glass 71 of conventional design which is mounted in a second port **60*b* formed in the closed end portion 47 of the member 45. When the engine is running, the sight glass 71** will fill with coolant only if the system is filled and thus, it can visually be determined whether coolant needs to be added to the system.

An alternative means for detecting the need for coolant in the system is shown in FIGS. 2 and 4 wherein a wire lead 73 is provided with one end thereof attached to a conventional ignition switch 75. The other end of wire lead 73 is attached to one side of a light emitting diode 77. An insulated conductor 79 is provided which is attached to a second side of the diode 77. The insulated conductor is attached to a terminal 80 which is mounted on the closed end portion 47 of member 46. A bare end portion 81 of the terminal 80 is disposed within the interior of filler neck 35 to be in contact with the coolant of the system, when the latter is filled with the coolant.

When the ignition switch is closed and the engine is heated, the diode 77 will emit light if the system is filled with coolant consisting of a solution of at least fifty percent ethylene glycol which will sufficiently conduct the current. Thus, if the system is filled with heated coolant, the diode 77 should emit light when the ignition is on. If the diode 77 fails to emit light after the engine block is heated, the operator is warned either that the coolant level is too low, that the coolant solution contains less than fifty percent ethylene glycol, or that the detecting system has failed. This alternative detecting system has cost advantages over other electrical detecting systems using a floating ball or capacitance sensor. Moreover, these devices provide for a light to be turned on only when the system is low on coolant. Thus, the operator will not be warned of failure of the electrical detecting system. In applicant's invention, the diode 77 will always emit light during the normal operation of a heated engine. Thus, the operator is warned of a failed detecting system by the failure of the diode to emit light.

It will be seen that the invention disclosed above overcomes the drawbacks of prior systems and achieves the aforestated objects. In particular, the invention provides for both limited de-aeration during the operation of the engine and complete venting when filling the system. The radiator vent lines are not required to be external to the de-aeration tank and no access hole is required to service the apparatus. An operator may quickly service the apparatus by removing cap 43 and eliminating any collected sediments from the first orifice **53*a* and the second orifice 53*b*** with a thin object such as a pin. It is to be understood, of course, that the number of grooves, orifices, and radiator vent conduits may be varied from that shown without departing from the scope of the invention.

Although the invention is particularly useful in the engine coolant system with a multi-pass radiator, it also benefits the operation of a simple engine coolant system using a single pass radiator common to most automobiles. In a typical automobile, the engine coolant system includes an engine block coolant jacket, a single pass radiator, a supply line from the bottom of the radiator to the coolant jacket, and a return line from the coolant jacket to the top of the radiator. The radiator includes a filler neck which is covered by a standard radiator cap and has a conduit connection on its side. An overflow conduit interconnects the conduit connection of the filler neck and an overflow container. A drawback of this system is that complete filling of the engine block coolant jacket cannot be achieved simply be inserting coolant into the filler neck. In carrying out the present invention on such a system, however, the overflow conduit is merely disconnected from the conduit connection of the filler neck enabling the cap to be readily removed. An engine vent conduit is provided to interconnect the engine block coolant jacket and the conduit connection of the filler neck. The standard radiator cap is replaced by a cap of the present invention having one annular groove, one orifice, and two resilient sealing bands. The overflow conduit is attached to the hollow stem of the cap and means are provided for pressurizing the system such as a pressure cap on the overflow container or a pressure/vacuum valve on the end of the overflow conduit. In this manner, the system may be completely and rapidly filled because the engine vent conduit vents the engine block coolant jacket during the filling of the system.

I claim:

1. A de-aerating apparatus used in an engine coolant system which includes an engine block coolant jacket and a radiator having a top header, said apparatus comprising a first container for receiving a coolant, said first container having a top surface provided with an opening; a second container mounted on the top surface of said first container, said second container having a bottom surface provided with an opening communicating with the opening in said first container top surface, said second container having a top surface provided with an opening for adding coolant to the cooling system; venting means for interconnecting said first container and said coolant jacket and providing a passageway for discharging gas and excess coolant from said jacket to said first container; filling means for interconnecting said first container and said coolant jacket and providing a passageway for discharging coolant from said first container to said jacket when said jacket is capable of receiving said coolant; at least one radiator vent conduit interconnecting said top header and said second container and providing a passageway for discharging gas and coolant from said top header to said second container; removable cap means for closing the top surface opening of said second container; an overflow conduit attached to said cap means whereby gas and excess coolant exits from said second container when such coolant has expanded a predetermined amount, forcing same to discharge from said second container; means for maintaining the pressure within the coolant system above atmospheric pressure; and adjustable means to throttle the flow of coolant and gas through said radiator vent conduit into said second container from said top header after filling.

2. The apparatus of claim 1 wherein said adjustable means decreases but does not completely preclude, the flow of coolant and gas through said radiator vent conduit into said second container, said adjustable means proximate to said second container.

3. The apparatus of claim 2, wherein said adjustable means comprises said removable cap means, said cap means decreasing the flow of gas and coolant in the second container when the cap means has closed the top surface opening of said second container, and said cap means not effecting the flow of gas and coolant into the second container when the cap means is in its removed position.

4. A de-aerating apparatus used in an engine coolant system which includes an engine block coolant jacket and a radiator having a top header, said apparatus comprising:

a first container for receiving a coolant, said first container having a top surface provided with an opening;

a second container mounted on the top surface of said first container, said second container having a bottom surface provided with an opening communicating with the opening in said first container top surface, said second container having a top surface provided with an opening for adding coolant to the cooling system;

venting means for interconnecting said first container and said coolant jacket and providing a passageway for discharging gas and excess coolant from said jacket to said first container;

filling means for interconnecting said first container and said coolant jacket and providing a passageway for discharging coolant from said first container to said jacket when said jacket is capable of receiving said coolant;

at least one radiator vent conduit interconnecting said top header and said second container and providing a passageway for discharging gas and coolant from said top header to said second container;

an overflow conduit;

removable cap means for closing the top surface opening of said second container, said cap means including a first member having a top surface provided with an aperture, said first member being removably secured to the top surface of said second container circumjacent the opening formed therein; a second member disposed within the top surface opening of said second container and subtending the top surface of said first member, said second member having a wall surface provided with at least one exterior groove, the latter communicating with an orifice, said groove being proximate a radiator vent conduit; connecting means mounted on the top surface of said cap second member and protruding outwardly therefrom and communicating with said overflow conduit, whereby gas and excess coolant exits from said second container when such coolant has expanded a predetermined amount, forcing same to discharge from said second container; and sealing means disposed on the exterior of said second member wall and on opposite sides of said groove;

and means for maintaining pressure within the coolant system above atmospheric pressure.

5. The apparatus of claim 4, wherein the groove of said cap second member circumscribes the exterior wall surface thereof.

6. The apparatus of claim 4, wherein the sealing means includes a pair of O-rings arranged in spaced relation relative to the groove.

7. The apparatus of claim 4, wherein the cap first member includes a peripheral flange which lockingly engages a lip encompassing the opening formed in the top surface of said second container.

8. The apparatus of claim 7, wherein the cap first member is independently rotatable relative to the said cap second member.

9. The apparatus of claim 4, wherein the top surface of said cap second member is provided with detecting means for determining a predetermined amount of coolant within the engine coolant system.

10. The apparatus of claim 9 wherein the detecting means includes a window formed in the top surface of the second member for visually determining the predetermined amount of coolant.

11. The apparatus of claim 9, wherein the detecting means includes a terminal mounted on the top surface of the second member; an electrical conductor communicating with the interior of said second container and in electrical contact with the coolant accumulated therein when at a predetermined level; and signal means connected to said conductor and energized when the coolant is at said predetermined level.

12. The apparatus of claim 4, wherein a third container is provided having a pressure venting means, and third container being in communication with said second container and accommodating overflow of the coolant from said second container when there is expansion of the coolant within said second container while the engine is in a predetermined mode of operation.

13. An apparatus used in an automotive engine cooling system which includes a radiator defining the opening, an engine block coolant jacket, a supply line from the radiator to said jacket, and a return line from said jacket to the radiator, said apparatus comprising a container disposed at the top of said radiator, said container having a top and a bottom and a conduit connection, a first opening through said bottom and a second opening through said top, said first opening communicating with said opening of said radiator, said a second opening for adding coolant to the cooling system; an engine vent conduit interconnecting said engine block coolant jacket and said conduit connection of said container thereby providing a passageway between said engine block coolant jacket and said container; removable cap means for sealing said second opening of said container; an overflow conduit extending through said cap means and communicating with said container; adjustable means to throttle said passageway between said engine block coolant jacket and said container after filling said system with coolant, so that said system may be rapidly filled with coolant when said passageway is not throttled; and means for maintaining the pressure in the system above atmospheric pressure.

14. The apparatus of claim 13 wherein said adjustable means decreases, but does not completely preclude, the flow of coolant and gas through said conduit connection, said adjustable means proximate to said container.

15. The apparatus of claim 14, wherein said adjustable means comprises said removable cap means, said cap means decreasing the flow of gas and coolant into the container when said cap means has closed said second opening of said container, and said cap means not effecting the flow of gas and coolant into said container when the cap means is in its removed position, thereby allowing rapid filling of the cooling system when said cap means is in the open position.

16. The apparatus of claim 15 wherein said cap means comprises a first member having a top surface provided with an aperture, said first member being removably secured to the top of said container circumjacent the opening formed therein; a second member disposed within the second opening of said container and subtending the top surface of said first member, said second member having a wall surface provided with at least one exterior groove, the latter communicating with an orifice, said groove being proximate the conduit connection; connecting means mounted on the top surface of said cap second member and protruding outwardly therefrom and communicating with said overflow conduit; and sealing means disposed on the exterior of said second member wall and on opposite sides of said groove.

17. The apparatus of claim 16, wherein the groove of said cap second member circumscribes the exterior wall surface thereof.

18. The apparatus of claim 16 wherein the sealing means includes a pair of O-rings arranged in spaced relative to the groove.

19. The apparatus of claim 16, wherein the cap first member includes a peripheral flange which lockingly engages the lip encompassing the opening formed in the top of said container.

* * * * *